US008242760B2

(12) United States Patent
Takagi et al.

(10) Patent No.: US 8,242,760 B2
(45) Date of Patent: Aug. 14, 2012

(54) CONSTANT-VOLTAGE CIRCUIT DEVICE

(75) Inventors: Yoshiki Takagi, Takarazuka (JP); Kenichi Watanabe, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 546 days.

(21) Appl. No.: 12/546,945

(22) Filed: Aug. 25, 2009

(65) Prior Publication Data

US 2010/0052636 A1 Mar. 4, 2010

(30) Foreign Application Priority Data

Aug. 29, 2008 (JP) ..... 2008-221981

(51) Int. Cl.
*G05F 1/569* (2006.01)

(52) U.S. Cl. ..... 323/276; 323/273; 323/908

(58) Field of Classification Search ..... 323/268, 323/271, 273–276, 312–317, 908
See application file for complete search history.

(56) References Cited

U.S. PATENT DOCUMENTS

| | | | | |
|---|---|---|---|---|
| 5,798,637 | A * | 8/1998 | Kim et al. | 323/313 |
| 6,204,653 | B1 * | 3/2001 | Wouters et al. | 323/313 |
| 7,538,537 | B2 | 5/2009 | Minakuchi et al. | |
| 8,018,214 | B2 * | 9/2011 | Kwon et al. | 323/271 |
| 2008/0061881 | A1 | 3/2008 | Takagi | |
| 2008/0218139 | A1 | 9/2008 | Takagi | |
| 2008/0224675 | A1 | 9/2008 | Takagi | |

FOREIGN PATENT DOCUMENTS

| | | |
|---|---|---|
| JP | 2-113314 | 4/1990 |
| JP | 8-69332 | 3/1996 |
| JP | 2002-49430 | 2/2002 |
| JP | 2006-114068 | 4/2006 |
| JP | 2006-276990 | 10/2006 |
| JP | 2006-277229 | 10/2006 |
| JP | 2006-285854 | 10/2006 |
| JP | 2007-133766 | 5/2007 |
| JP | 2007-334573 | 12/2007 |
| JP | 2007-59313 | 3/2008 |
| JP | 2008-67186 | 3/2008 |
| JP | 2008-217677 | 9/2008 |
| JP | 2008-225952 | 9/2008 |
| JP | 2009-123172 | 6/2009 |

* cited by examiner

*Primary Examiner* — Matthew Nguyen
(74) *Attorney, Agent, or Firm* — Cooper & Dunham LLP

(57) ABSTRACT

A constant-voltage circuit converts a voltage input to an input terminal and outputs a predetermined constant voltage from an output terminal. The constant-voltage circuit includes an output transistor to output an electrical current to the output terminal in response to a control signal, a reference voltage circuit to generate a predetermined reference voltage, a control circuit to adjust a voltage proportional to the output voltage output from the output terminal to the reference voltage output from the reference voltage circuit by controlling the output transistor and a soft start circuit including a capacitor for soft start that is charged at start-up and a current control unit to control an electrical current supplied to the reference voltage circuit. The current control unit adjusts the reference voltage to a voltage determined by the capacitor for soft start at the start-up until the reference voltage reaches a desired voltage.

19 Claims, 11 Drawing Sheets

CONSTANT-VOLTAGE CIRCUIT DEVICE

CROSS-REFERENCE TO RELATED APPLICATIONS

This patent specification is based on and claims priority from Japanese Patent Application No. 2008-221981, filed on Aug. 29, 2008 in the Japan Patent Office, which is hereby incorporated by reference herein in its entirety.

BACKGROUND OF THE INVENTION

1. Field of the Invention

The present invention generally relates to a constant-voltage circuit device for a whole category of electronic equipment aboard a computerized personal organizer, a handset, a voice recognition device, a voice memory device, or a computer, etc.

2. Discussion of the Background

Generally, in constant-voltage circuit devices, when an output capacitor has discharged almost all the electricity stored therein at the start-up, electrical current flows to the output capacitor until it is charged with a sufficient amount of electricity. This charge current at the start-up is hereinafter referred to as "inrush current Irush". How the inrush current Irush occurs and problems caused thereby are described below with reference to FIG. 1.

FIG. 1 illustrates a known constant-voltage circuit device using a series regulator.

Referring to FIG. 1, the known constant-voltage circuit device includes an output transistor M101 that is a PMOS (P-channel Metal Oxide Semiconductor) transistor, a reference voltage circuit 1Z that generates a predetermined or given reference voltage Vref, a differential amplifier circuit 2Z, and resistors R101 and R102 used to detect an output voltage.

The differential amplifier circuit 2Z includes NMOS (N-channel Metal Oxide Semiconductor) transistors M102 and M103, PMOS transistors M104 and M105, and a constant-current source I101 that receives a constant current from a constant-current circuit. Gates of the NMOS transistors M102 and M103 serve as input terminals of the differential amplifier circuit 2Z. The PMOS transistors M104 and M105 together form a current mirror circuit.

The gate of the NMOS transistor M102 serves as an inverting input terminal to which the reference voltage Vref is input, and the gate of the NMOS transistor M103 serves as a non-inverting input terminal. The resistors R101 and R102 are connected in series to an output side of the output transistor M101 and divides an output voltage Vout into a divided voltage Vfb. The divided voltage Vfb is given to the non-inverting input terminal of the differential amplifier circuit 2Z.

The differential amplifier circuit 2Z amplifies differences between the divided voltage Vfb and the reference voltage Vref and outputs the amplified difference to a gate of the output transistor M101. Thus, the output transistor M101 is controlled so that the output voltage Vout output therefrom is kept at a given constant voltage.

Additionally, an output capacitor C101 is externally connected to the output side of the output transistor M101 to smooth the output voltage, and the output transistor M101 is provided with an overcurrent protection circuit 3Z that controls the gate of the output transistor M101 when an output current Iout exceeds a limit current ILMT, thereby controlling the output current Iout.

In this known constant-voltage circuit device, when no or only an extremely small amount of electricity is stored in the output capacitor C101 at the start-up, the output side has an extremely low impedance. Accordingly, a charge current, that is, the inrush current Irush flows until the output capacitor C101 is charged with a sufficient amount of electricity, and then the impedance of the output side becomes high. An upper limit of the inrush current Irush equals the limit current ILMT set by the overcurrent protection circuit 3Z, and a time period during which the inrush current Irush flows depends on the capacity of the output capacitor C101 as well as the limit current ILMT.

FIGS. 2A, 2B, and 2C respectively illustrate waveforms of a power source voltage Vdd; the reference voltage Vref and the output voltage Vout; and the output current Iout in the known constant-voltage circuit device shown in FIG. 1 at the start-up. The output current Iout is the sum of the inrush current Irush and a load current Iload. The waveforms shown in FIGS. 2A, 2B, and 2C are obtained when the power source voltage Vdd is 3.0 V, the output voltage Vout is 1.2 V, the reference voltage Vref is 1.0 V, the output capacitor C101 is 0.5 μF, Rout is 120Ω, and the limit current ILMT is 400 mA.

As shown in FIG. 2B, the reference voltage Vref rises relatively promptly, and accordingly the output voltage Vout rises in a relatively short time. At this time, an inrush current Irush of about 3 Z mA flows because the electric current flows to the output capacitor C101 abruptly.

When the capacitance of the output capacitor C101 is 10 μF, the waveforms of the power source voltage Vdd, the reference voltage Vref, the output voltage Vout, and the output current Iout shown in FIG. 2A through 2C change to those shown in FIG. 3A through 3C.

Although the inrush current Irush may be as large as several amperes if the overcurrent protection circuit 3Z is not provided, the inrush current Irush shown in FIG. 3B depends on the limit current ILMT set by the overcurrent protection circuit 3Z.

When the output voltage Vout rises abruptly as shown in FIG. 3B, the inrush current Irush flows from the power source voltage Vdd to the output capacitor C101 until the output capacitor C101 is sufficiently charged. Although, more precisely, the sum of the inrush current Irush and the load current Iload flows to the output capacitor C101, the load current Iload at the start-up is generally so small as to be negligible compared to the inrush current Irush.

Moreover, if the power source voltage Vdd has a current capacity lower than the inrush current Irush, the power source voltage Vdd will decrease, and there is a possibility that all the circuits connected in parallel to the constant-voltage circuit might fail to start up. Although this inconvenience may be solved by increasing the current capacity of the power source voltage Vdd, the cost of the constant-voltage circuit device will increase accordingly, which is undesirable.

Because the electrical current supplied by the output transistor M101 changes from the inrush current Irush to the load current Iload determined by a load resistor Rout at the moment the output voltage Vout reaches a given intended voltage, the differential amplifier circuit 2Z fails to promptly control the output transistor M101, causing the output voltage Vout to overshoot. As a result, noise is generated in later-stage circuitry, which can invite malfunction of the device.

Although this problem may be solved by increasing the response speed of the differential amplifier circuit 2Z, the electricity consumed by the overall constant-voltage circuit will increase accordingly. In addition, although the overshoot of the output voltage Vout can be reduced by increasing the capacity of the output capacitor C101, which is known when the waveforms shown in FIGS. 2A through 2C are compared with those shown in FIGS. 3A through 3C, increasing the capacity of the output capacitor C101 means that the inrush current Irush flows for a longer time period, and accordingly the power source voltage Vdd will decrease, which is undesirable.

In view of the foregoing, known power source devices include a soft start function so that the output voltage can be gradually increased by gradually increasing the voltage input thereto at the start-up.

However, in such known power source devices, because the reference voltage Vref is switched between multiple voltages using a switch, noise is generated, which can invite malfunction of the device.

Therefore, there is a need to provide a voltage generation circuit that can restrict the inrush current at the start-up with a simple configuration without increasing the electrical consumption and can raise the constant output voltage without overshooting.

SUMMARY OF THE INVENTION

In view of the foregoing, in one illustrative embodiment of the present invention, a constant-voltage circuit device converts a voltage input to an input terminal and outputs a predetermined constant voltage from an output terminal.

The constant-voltage circuit device includes an output transistor to output an electrical current to the output terminal in response to a control signal, a reference voltage circuit to generate a predetermined reference voltage, a control circuit to adjust a voltage proportional to the output voltage output from the output terminal to the reference voltage output from the reference voltage circuit by controlling the output transistor, and a soft start circuit. The soft start circuit includes a capacitor for soft start that is charged at start-up and a current control unit to control an electrical current supplied to the reference voltage circuit. The current control unit adjusts the reference voltage to a voltage determined by the capacitor for soft start at the start-up until the reference voltage reaches a desired voltage.

In another illustrative embodiment, a constant-voltage circuit device includes the output transistor, the reference voltage circuit, the control circuit to adjust a voltage proportional to the output voltage output from the output terminal to the reference voltage output from the reference voltage circuit by controlling the output transistor, and a soft start circuit including a capacitor for soft start that is charged at start-up, a current detection unit, and a charge-current control unit. The soft start circuit raises the output voltage output from the output terminal according to a time period during which the capacitor for soft start is charged. The current detection unit detects an electrical current flowing to the output transistor. The charge-current control unit controls a charge given to the capacitor for soft start according to an electrical current detected by the current detection unit at the start-up.

Yet in illustrative embodiment, a constant-voltage circuit device includes the output transistor, the reference voltage circuit, the control circuit to adjust a voltage proportional to the output voltage output from the output terminal to the reference voltage output from the reference voltage circuit by controlling the output transistor, and a soft start circuit including a capacitor for soft start that is charged at start-up, a voltage difference detection unit, and a charge-current control unit. The soft start circuit to raise the output voltage output from the output terminal according to a time period during which the capacitor for soft start is charged. The voltage difference detection unit detects a difference between the input voltage and the constant voltage output from the output terminal, and the charge-current control unit controls a charge given to the capacitor for soft start according to the difference detected by the voltage difference detection unit at the start-up.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
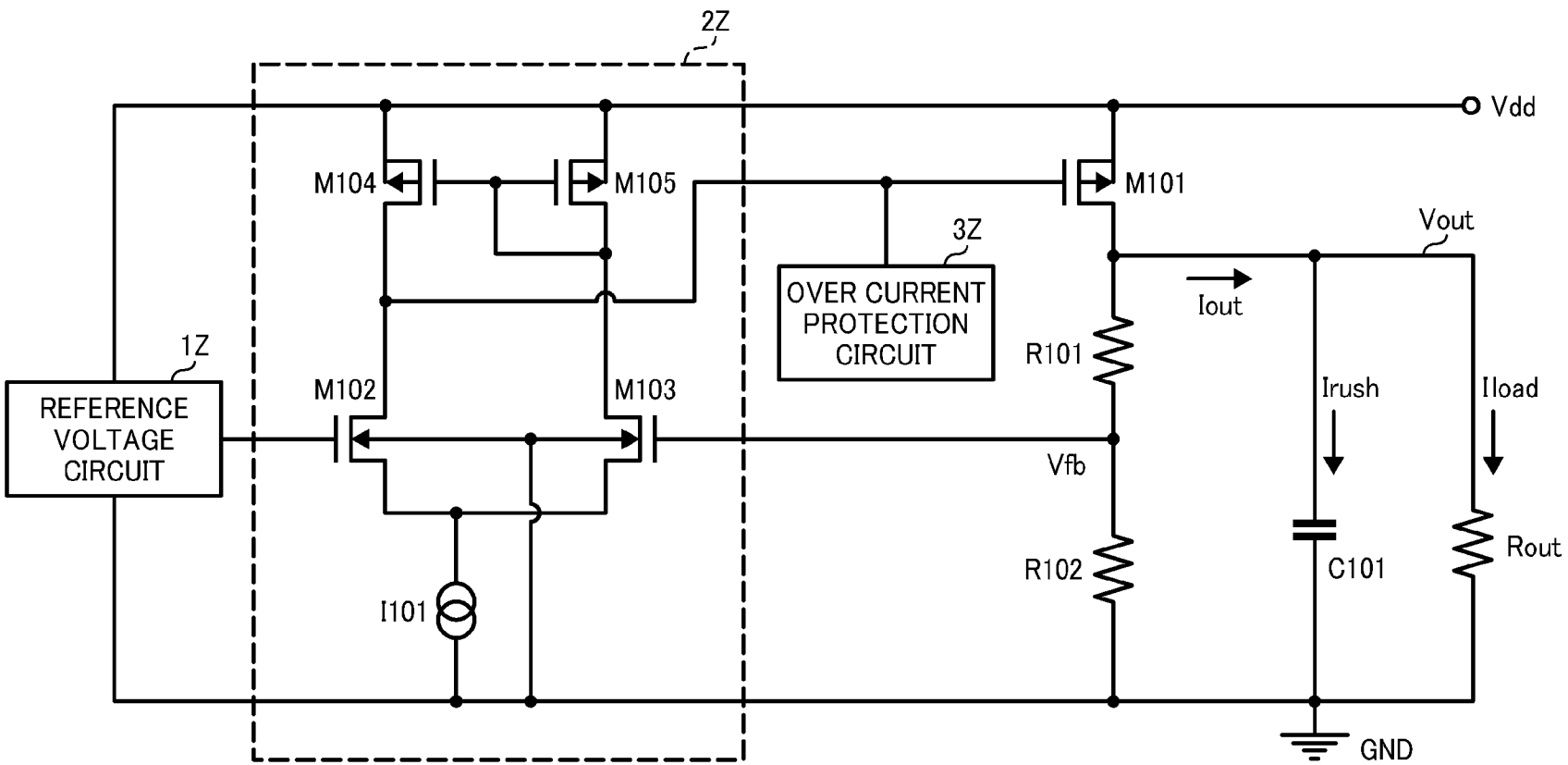
FIG. 1 RELATED ART
FIG. 1 illustrates circuitry of a known constant-voltage circuit device using a series regulator.
Figure 2A:
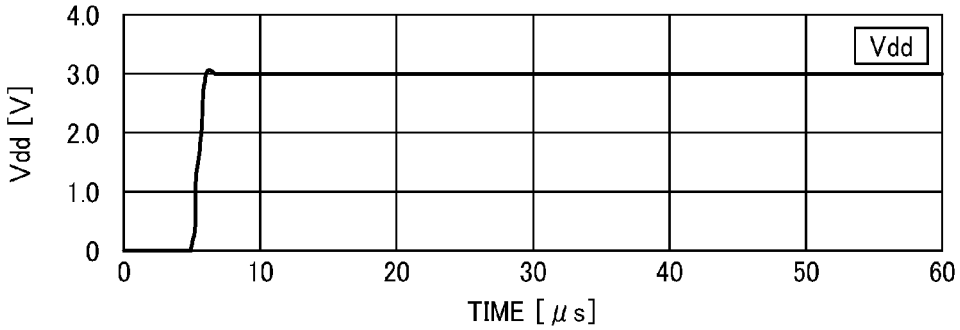
FIG. 2A RELATED ART
FIGS. 2A, 2B, and 2C respectively illustrate waveforms of a power source voltage Vdd; a reference voltage Vref and an output voltage Vout; and an output current Iout in the known constant-voltage circuit device shown in FIG. 1.
Figure 2B:
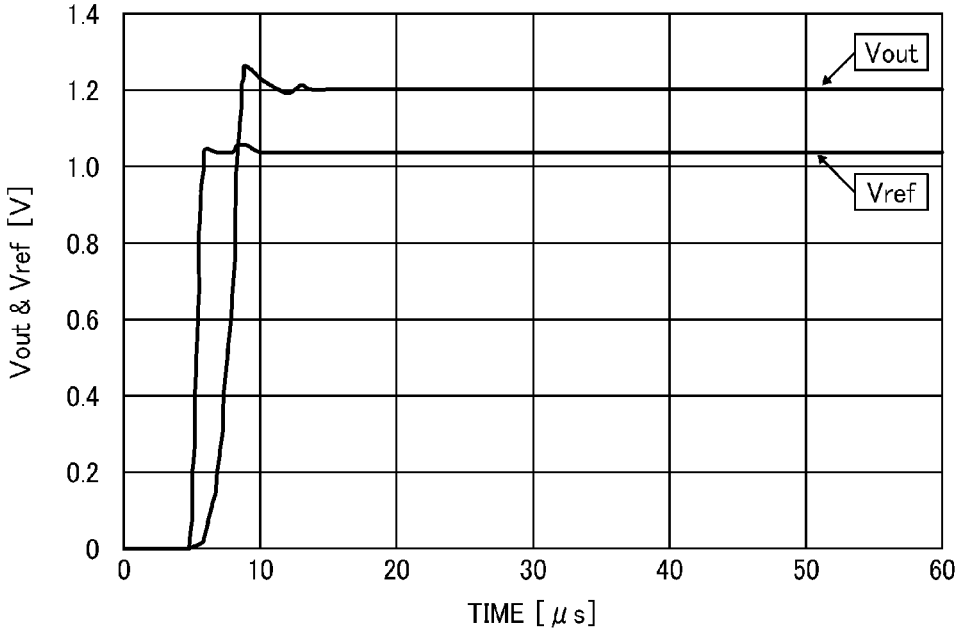
FIG. 2B RELATED ART
Figure 2C:
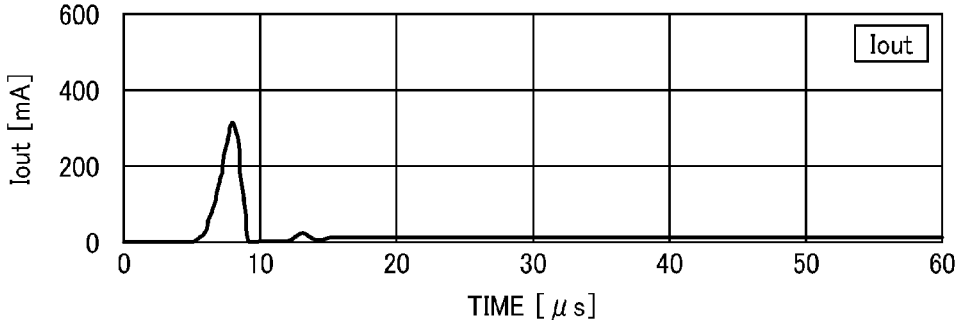
FIG. 2C RELATED ART
Figure 3A:
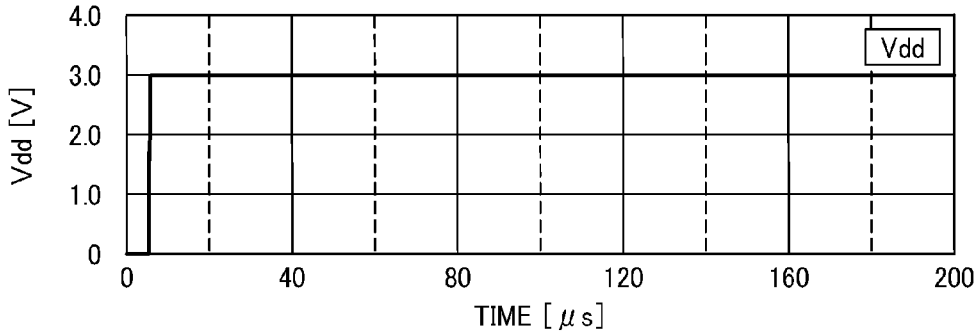
FIG. 3A RELATED ART
FIGS. 3A, 3B, and 3C respectively illustrate waveforms of a power source voltage Vdd; a reference voltage Vref and an output voltage Vout; and an output current Iout in the known constant-voltage circuit device shown in FIG. 1.
Figure 3B:
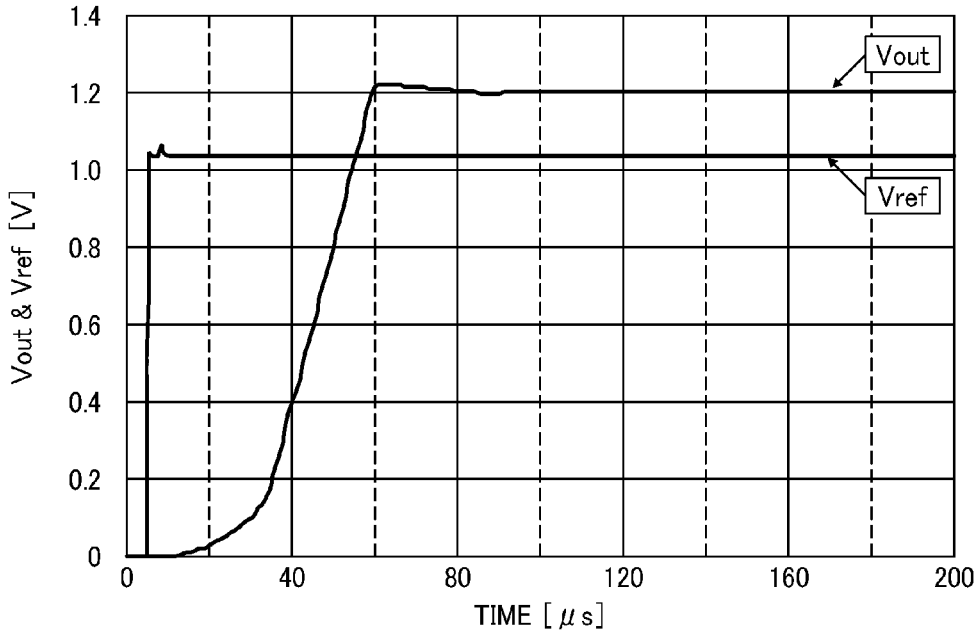
FIG. 3B RELATED ART
Figure 3C:
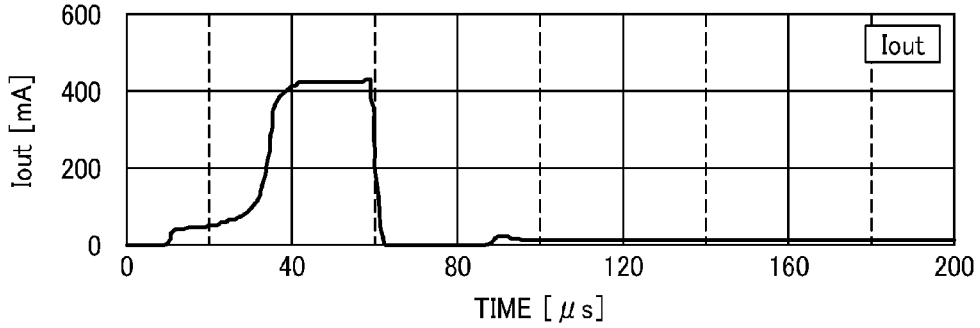
FIG. 3C RELATED ART

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 4:
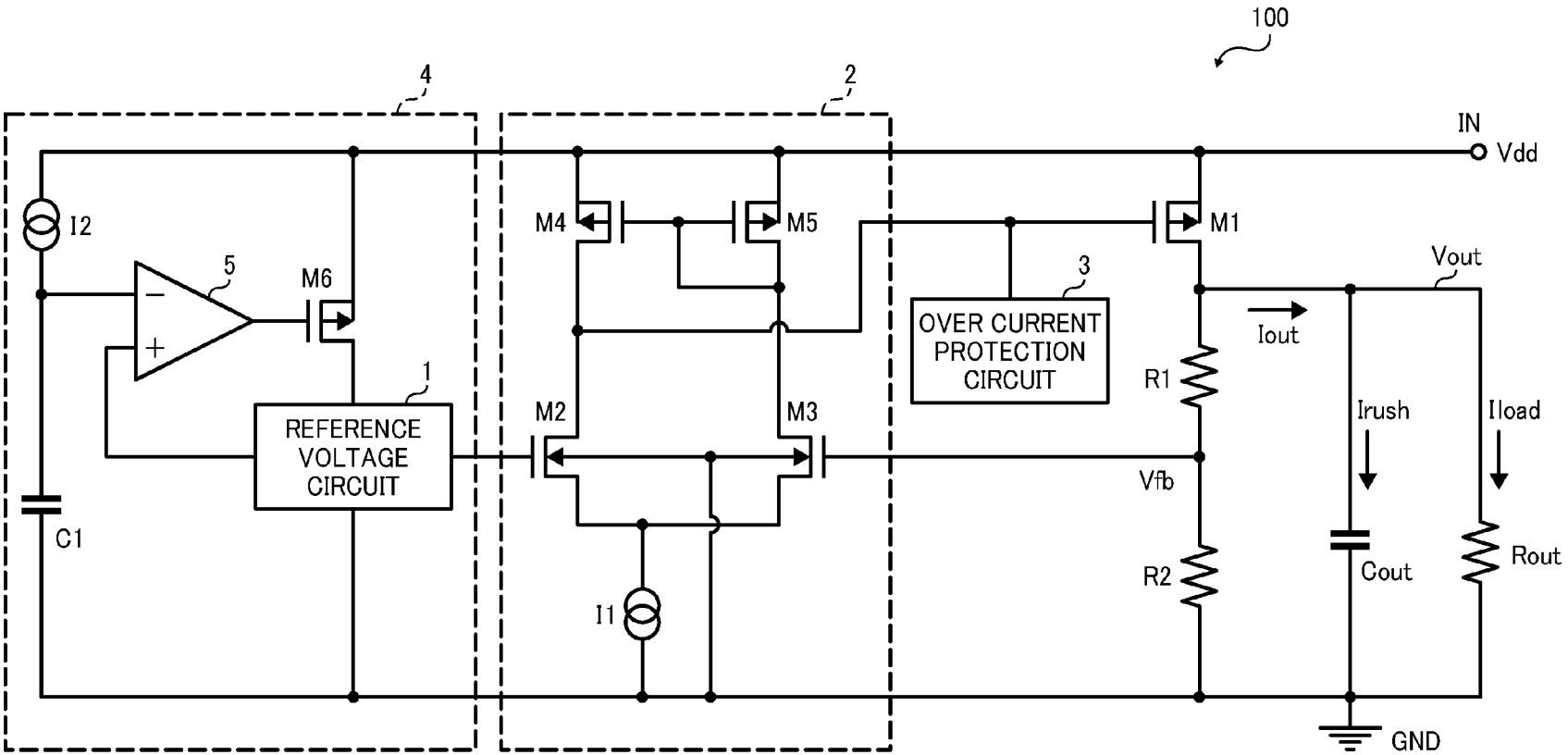
FIG. 4 illustrates circuitry of a constant-voltage circuit device using a series regulator according to an illustrative embodiment of the present invention.

Referring now to the drawings, wherein like reference numerals designate identical or corresponding parts throughout the several views thereof, and particularly to FIG. 4, a configuration of a constant-voltage circuit device using a series regulator according to an illustrative embodiment of the present invention is described.

Referring to FIG. 4, a constant-voltage circuit device 100 includes an output transistor M1 that is a PMOS transistor, a differential amplifier circuit 2, an overcurrent protection circuit 3, a soft start circuit 4, and resistors R1 and R2 used to detect an output voltage Vout.

The differential amplifier circuit 2, serving as a differential amplifier, includes NMOS transistors (input transistors) M2 and M3, PMOS transistors M4 and M5, and a constant-current source I1 that receives a constant current from a constant-current circuit. Sources of the NMOS transistors M2 and M3, serving as a differential pair, are connected together. The constant-current source I1, serving as a current source of the differential pair, is connected between a ground voltage and the junction node between the NMOS transistors M2 and M3. The PMOS transistors M4 and M5 together serve a load of the differential pair and form a current mirror circuit. A predetermined or given reference voltage Vref generated by a reference voltage circuit 1 is input to a gate of the NMOS transistor M2. The resistors R1 and R2 divide the output voltage Vout into a divided voltage Vfb, which is input to a gate of the NMOS transistor M3.

Sources of the PMOS transistor M4 and M5 are connected to an input terminal IN, and their gates are connected together. A junction node between the gates of the PMOS transistor M4 and M5 is connected to a drain of the PMOS transistor M5. A drain of the PMOS transistor M4 is connected to a drain of the NMOS transistor M2, and its junction node serves as an output terminal of the differential amplifier circuit 2.

The gates of the NMOS transistors M2 and M3 serve as input terminals of the differential amplifier circuit 2. More specifically, the gate of the NMOS transistor M2 serves as an inverting input terminal and receives the reference voltage Vref from the reference voltage circuit 1, and the gate of the NMOS transistor M3 serves as a non-inverting input terminal and receives the divided voltage Vfb as described above.

The differential amplifier circuit 2 amplifies the difference between the divided voltage Vfb and the reference voltage Vref and then outputs the amplified difference to a gate of the output transistor M1. Thus, the differential amplifier circuit 2 serves as a control circuit to control the output transistor M1 to keep the output voltage Vout at a predetermined or given constant voltage.

Additionally, an output capacitor Cout for smoothing is externally connected to the output side of the output transistor M1, and the output transistor M1 is provided with the overcurrent protection circuit 3 that controls the gate of the output transistor M1 when an output current Iout exceeds a predetermined or given limit current ILMT, thereby controlling the output current Iout.

As shown in FIG. 4, the soft start circuit 4 includes a differential amplifier circuit 5, a constant current source I2, a capacitor C1 for soft start, and a PMOS transistor M6 for controlling the reference voltage circuit 1. The transistor M6 serves as a control transistor forming a current control circuit that controls the electrical current that flowing to the reference voltage circuit 1.

A non-inverting input terminal of the differential amplifier circuit 5 serves as a first input terminal and receives the reference voltage Vref from the reference voltage circuit 1. An inverting input terminal of the differential amplifier circuit 5 serves as a second input terminal and is connected to a junction node between the constant current source I2 and the capacitor C1 for soft start. A source of the PMOS transistor M6 is connected to the input terminal IN, its drain is connected to the reference voltage circuit 1, and its gate (control electrode) receives an output from the differential amplifier circuit 5.

Next, operations of the above-described constant-voltage circuit device 100 using the series regulator are described below.

At the start-up of the constant-voltage circuit device 100, the voltage at the inverting input terminal of the differential amplifier circuit 5 increases at a time constant determined by the constant current source I2 and the capacitor C1 for soft start. Although the reference voltage Vref tends to rise abruptly, when the reference voltage Vref exceeds the voltage at the inverting input terminal, the differential amplifier circuit 5 increases a gate voltage of the PMOS transistor M6 so as to control the electrical current supplied to the reference voltage Vref, thereby restricting the increase in the reference voltage Vref. As a result, the reference voltage Vref can rise from 0 V to a desired given voltage, for example, 1.0 V, gradually and linearly at the time constant determined by the constant current source I2 and the capacitor C1 for soft start.

After the reference voltage Vref reaches the desired voltage, although the voltage at the inverting input terminal increases at the above-described time constant, that does not affects the performance of the reference voltage circuit 1 after start-up because the reference voltage Vref is constantly lower, and accordingly the gate voltage of the PMOS transistor M6 decreases to close the ground voltage.

According to the reference voltage Vref that is input to its inverting input terminal (gate of the NMOS transistor M2), the differential amplifier circuit 2 outputs a desired or give voltage to the output voltage Vout. It is to be noted that the input transistors M2 and M3 are preferably depression-type type transistors so that the differential amplifier circuit 2 can operate even when the reference voltage Vref is 0 V.

Figure 5:
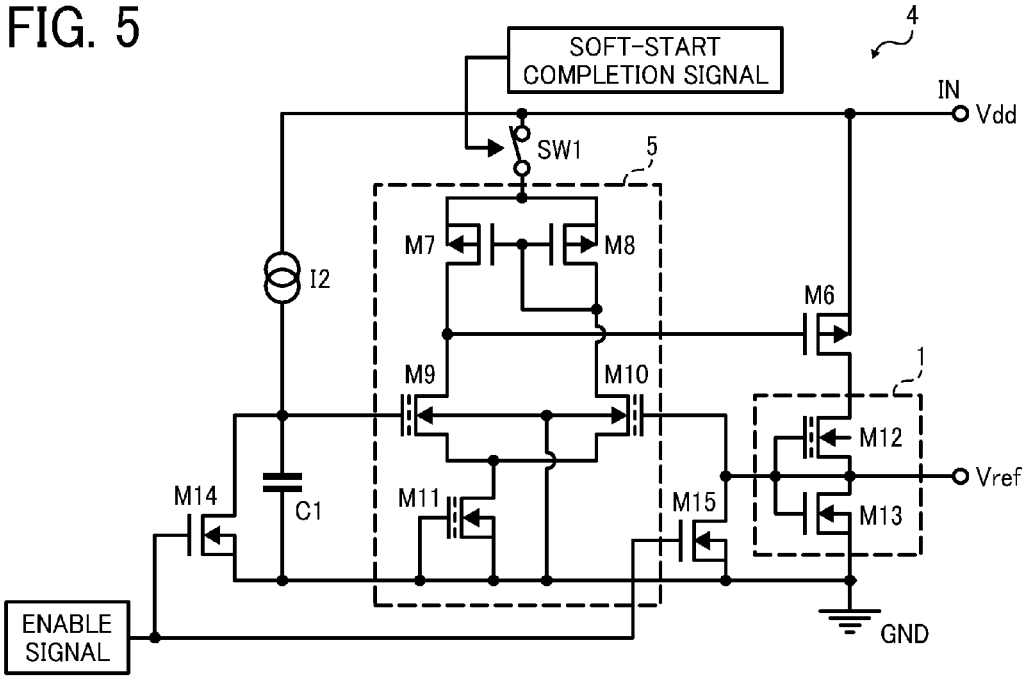
FIG. 5 illustrates circuitry of a soft start circuit according to an illustrative embodiment.

FIG. 5 is circuitry of the soft start circuit 4.

Referring to FIG. 5, the reference voltage circuit 1 is formed by a depression-type NMOS transistor M12 and an NMOS transistor M13 that are connected through saturated connection. The depression-type NMOS transistor M12 is connected to the input terminal IN via the transistor M6 for controlling the reference voltage circuit 1. A source of the NMOS transistor M13 is connected to the ground voltage.

The electrical current generated in the depression-type NMOS transistor M12 flows through the saturation-connected NMOS transistor 13, and thus the reference voltage circuit 1 generates the predetermined reference voltage Vref.

The differential amplifier circuit 5 includes PMOS transistors M7 and M8; and NMOS transistors M9 through M11. the NMOS transistors M9 and M10 form a differential pair, and their sources are connected together. The NMOS transistor M11 is connected between the ground voltage and a junction node between the sources of the NMOS transistors M9 and M10. The PMOS transistors M7 and M8 together serve a load of the differential pair and form a current mirror circuit. The reference voltage Vref is input to a gate of the NMOS transistor M10, and a gate of the NMOS transistor M9 is connected to the junction node between the constant current source I2 and the capacitor C1 for soft start. The gate of the NMOS transistor M9 is further connected to a drain of a NMOS transistor M14 that is activated by an enable signal. The gate of the NMOS transistor M10 is further connected to a drain of a NMOS transistor M15 that is activated by an enable signal. Sources of the NMOS transistors M14 and M15 are connected to the ground voltage.

By contrast, sources of the PMOS transistors M7 and M8 are connected to the input terminal IN via a switch SW1. A junction node between gates of the PMOS transistors M7 and M8 is connected to a drain of the PMOS transistor M8. The drain of the PMOS transistor M8 is connected to a drain of the NMOS transistor M10. A junction node between drains of the MOS transistor M7 and of the NMOS transistor M9 serves as an output terminal of the differential amplifier circuit 5.

It is preferred the NMOS transistors (input transistors) M9 and M10 be depression-type type transistors so that the differential amplifier circuit 5 can operate even when the reference voltage Vref is 0 V. The input transistors M9 and M10 may be of the same or similar size. Alternatively, the gate width (W length) of the input transistor M9 can be shorter, or the gate length (L length) of the input transistor M9 can be longer, thereby providing an offset, so as to delay the rise of the reference voltage Vref until the other circuits are stabilized at the start-up.

Because the differential amplifier circuit 5 should operate immediately after the start-up, the depression-type NMOS transistor M11 controls a tail current of the differential amplifier circuit 5 in the present embodiment. The differential amplifier circuit 5 may use a constant current source supplied by a constant current circuit similarly to the differential amplifier circuit 2. However, because constant current circuits generally rise slowly, it is possible that the differential amplifier circuit 5 fails to rise promptly, generating noise in the reference voltage Vref. Therefore, when a constant current circuit is used, countermeasures such as delaying the start of the soft start circuit 4, and the like are required, thus increasing the circuit size.

The NMOS transistors M14 and M15 together form a discharge unit that discharges the respective voltages from both input terminals, that is, the gates of the NMOS transistors M9 and M10, of the differential amplifier circuit 5 when the enable signal is off, and then soft start-up can be performed again at the restart. Similarly, when the output voltage Vout is short-circuited or a thermal protection circuit has operated, the voltages at the both input terminals of the differential amplifier circuit 5 may be discharged. As a result, a similar effect can be obtained when the output voltage Vout is restored from the short-circuit state or an abnormal state such as a heat generating state.

After the reference voltage Vref rises to the predetermined voltage, and then a soft-start completion signal indicating that the soft start-up is completed is sent thereto, the switch SW1 turns off, thereby reducing electrical current consumption of the differential amplifier circuit 5. The amount of the electrical current may be reduced to not zero but to one tenth when noise is noticeable at the restart from the state in which the electrical current is zero.

Because the voltage at the inverting input terminal rises to the power source voltage Vdd eventually, the soft-start completion signal can be generated relatively easily when the voltage at the inverting input terminal is monitored and the signal is generated when that voltage reaches a given threshold voltage. The same signal may be used to pull up the voltage at the inverting input terminal to the power source voltage Vdd so as to prevent or reduce malfunction that occurs around the threshold voltage.

Figure 6:
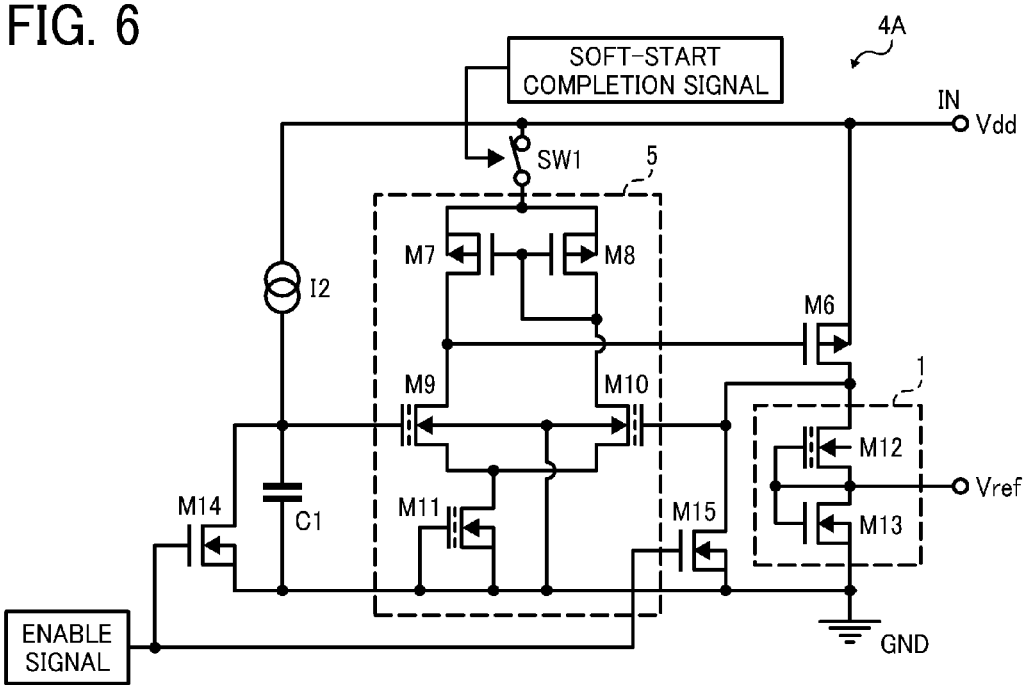
FIG. 6 illustrates circuitry of a soft start circuit according to another illustrative embodiment.

FIG. 6 illustrates circuitry of a soft start circuit 4A according to another embodiment in which, differently from the soft start circuit 4 shown in FIG. 5, a non-inverting input terminal (gate of the NMOS transistor M10) of a differential amplifier circuit 5 is connected to not the reference voltage Vref but the drain voltage of the NMOS transistor M12 in FIG. 6.

In the configuration shown in FIG. 5, ripples of the power source voltage Vdd tend to appear on the reference voltage Vref through the gate-drain capacity of the NMOS transistor M10 and the gate-source capacity of the PMOS transistor M7. When the electrical current flowing through the reference voltage circuit is relatively large, those ripples can be ignored. However, when that electrical current is relatively small, those ripples cannot be removed. As a result, the ripple removal ratio throughout the constant-voltage circuit can be degraded.

Therefore, as shown in FIG. 6, the drain voltage of the NMOS transistor M12 is connected to the non-inverting input terminal of the differential amplifier circuit 5 so that the ripples of the power source voltage Vdd do not affect the reference voltage Vref.

Additionally, in this configuration, the differential amplifier circuit 5 operates so that a voltage higher then the reference voltage Vref by an amount corresponding to the voltage between the drain and the source of the NMOS transistor M12 equals the voltage determined by the constant current source I2 and the capacitor C1 for soft start. Therefore, the rise of the reference voltage Vref can be delayed without providing the offset in the NMOS transistors M9 and M10, and thus there can be a sufficient time for other circuits to be stabilized.

Figure 7A:
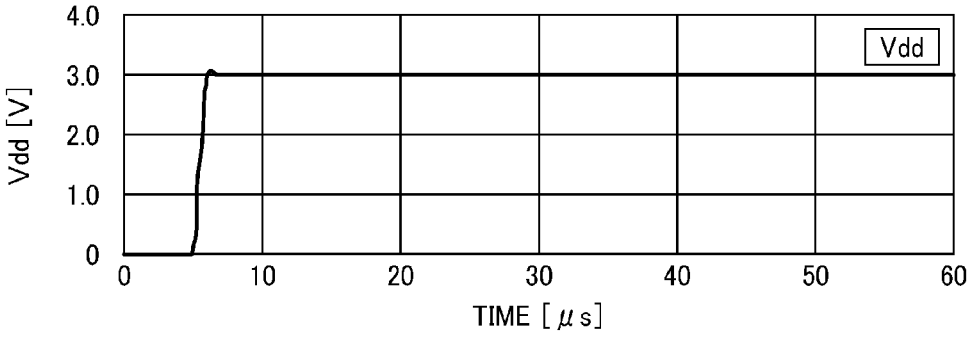
FIGS. 7A, 7B, and 7C respectively illustrate relations between time at the start-up and waveforms of a power source voltage Vdd; a reference voltage Vref and an output voltage Vout; and an output current Iout in the constant-voltage circuit device shown in FIG. 4.
Figure 7B:
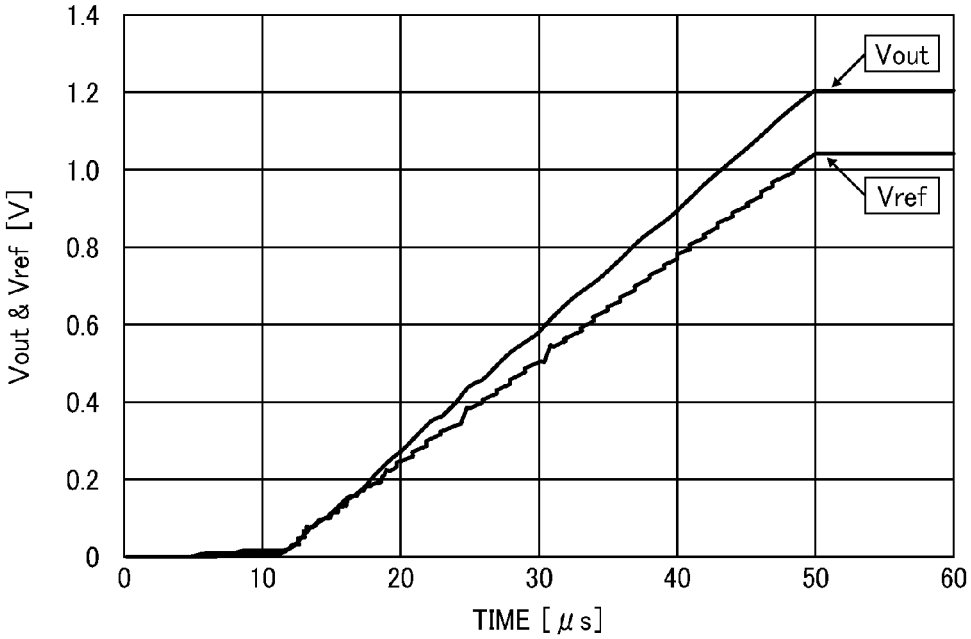
Figure 7C:
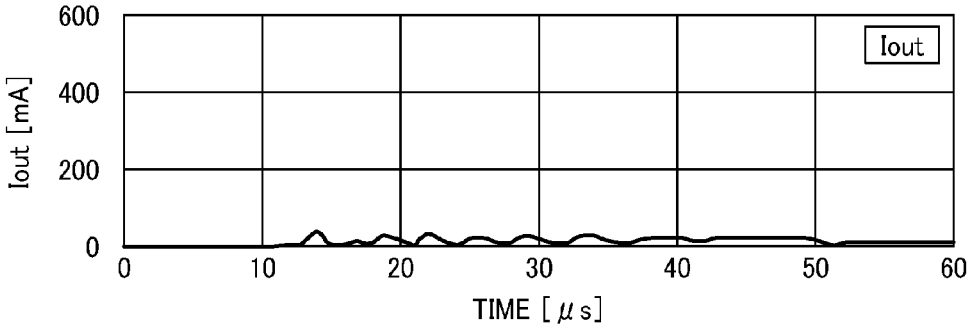

FIGS. 7A, 7B, and 7C respectively illustrate the relations between time at the start-up and waveforms of the power source voltage Vdd; the reference voltage Vref and the output voltage Vout; and the output current Iout in the constant-voltage circuit device 100 shown in FIG. 4.

The output current Iout is the sum of the inrush current Irush and a load current Iload. The waveforms shown in FIGS. 7A, 7B, and 7C are obtained when the power source voltage Vdd is 3.0 V, the output voltage Vout is 1.2 V, the reference voltage Vref is 1.0 V, the output capacitor Cout is 0.5 μF, Rout is 120Ω, and a soft start period is 40 μs.

Referring to FIG. 7B, the reference voltage Vref rises slowly and linearly at the time constant determined by the constant current source I2 and the capacitor C1. Because the output voltage Vout rises slowly according to the increase in the reference voltage Vref, an electrical current as small as 10 mA flows through the output capacitor Cout. As a result, the output voltage Vout seldom overshoot after the soft start-up is completed. Similar effects can be attained when the soft start circuit 4A shown in FIG. 6 is used.

These circuits are very effective when the size of the output capacitor Cout connected to a load side and tht of the output voltage Vout are within a given range. For example, when the output capacitor Cout is within a range from 1 μF to 2.2 μF and the output voltage Vout is within a range from 1.2 V to 1.5 V, a soft start period of 40 μs is sufficient for the output voltage Vout to rise to the predetermined voltage. However, from the viewpoint of versatility, the output voltage Vout and, in particular, the output capacitor Cout are not constant.

Figure 8A:
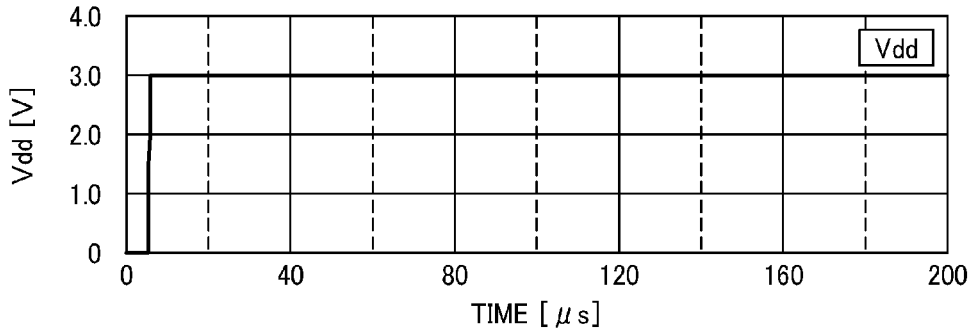
FIGS. 8A, 8B, and 8C respectively illustrate relations between time at the start-up and waveforms of a power source voltage Vdd; a reference voltage Vref and an output voltage Vout; and an output current Iout in the constant-voltage circuit device shown in FIG. 4.
Figure 8B:
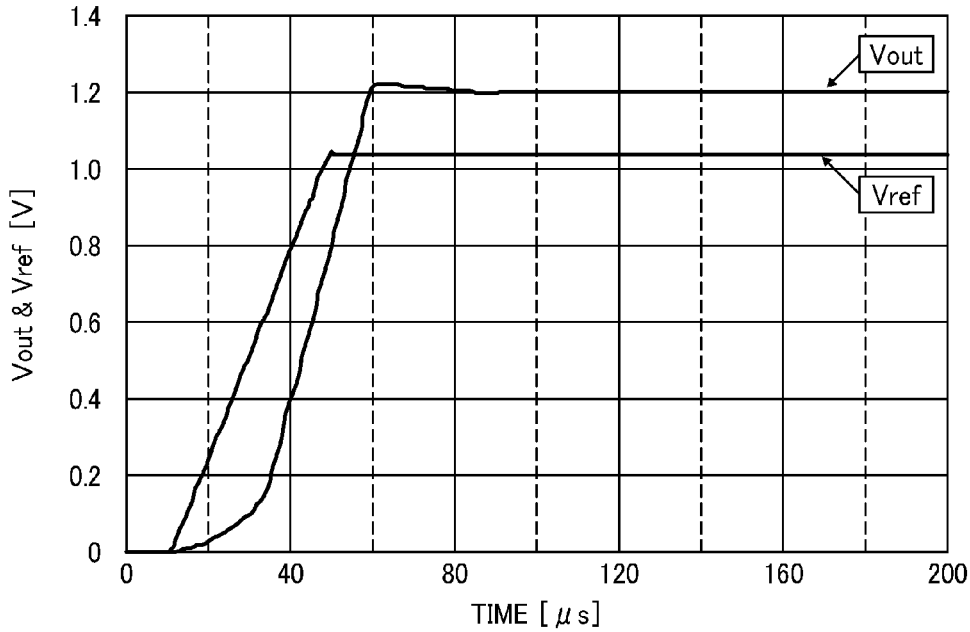
Figure 8C:
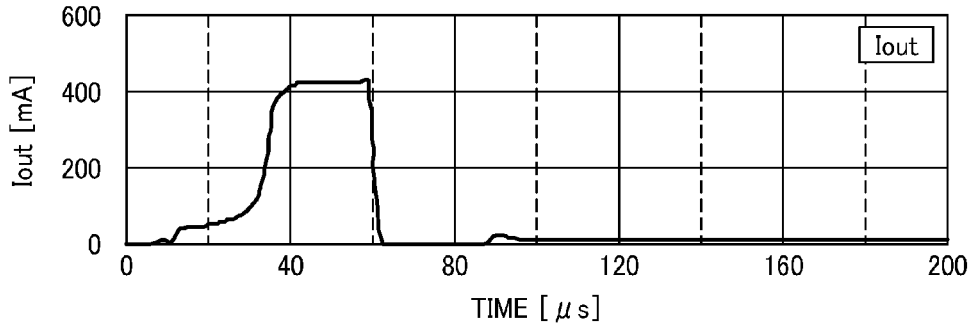

FIGS. 8A, 8B, and 8C illustrate the respective waveforms in the constant-voltage circuit device 100 shown in FIG. 4 when the output capacitor Cout is changed to 10 μF from 0.5 μF. Although the reference voltage Vref rises at about 40 μs similarly to the waveform shown in FIG. 7B, the charge current has increased because the capacity of the output capacitor Cout has increased to 20 times as large as its former capacity. Therefore, the reference voltage Vref rises while charging the output capacitor Cout with the limit current ILMT set by the overcurrent protection circuit 3. As a result, the output voltage Vout fails to follow the reference voltage Vref, and thus soft start-up cannot be performed properly.

Although the soft start-up can be performed properly if the soft start period is increased to 100 μs from 40 μs, adjusting it each time is difficult because the performance of output capacitors depends on usage conditions.

Moreover, if the input voltage is increased irregularly, for example, increased from 0 V to 2.5 V and then further increased from 2.5 V to 5.0 V, the output voltage cannot follow the reference voltage Vref because the input voltage stops to rise at 2.5 V and then rises again. Then, the reference voltage Vref has already risen to the predetermined voltage before the input voltage rises to 5.0 V. Therefore, soft start-up cannot be performed and thus the inrush current will flow. Although this may be prevented by increasing the soft start period, adjusting it each time is difficult because the performance of output capacitors depends on usage conditions.

Figure 9:
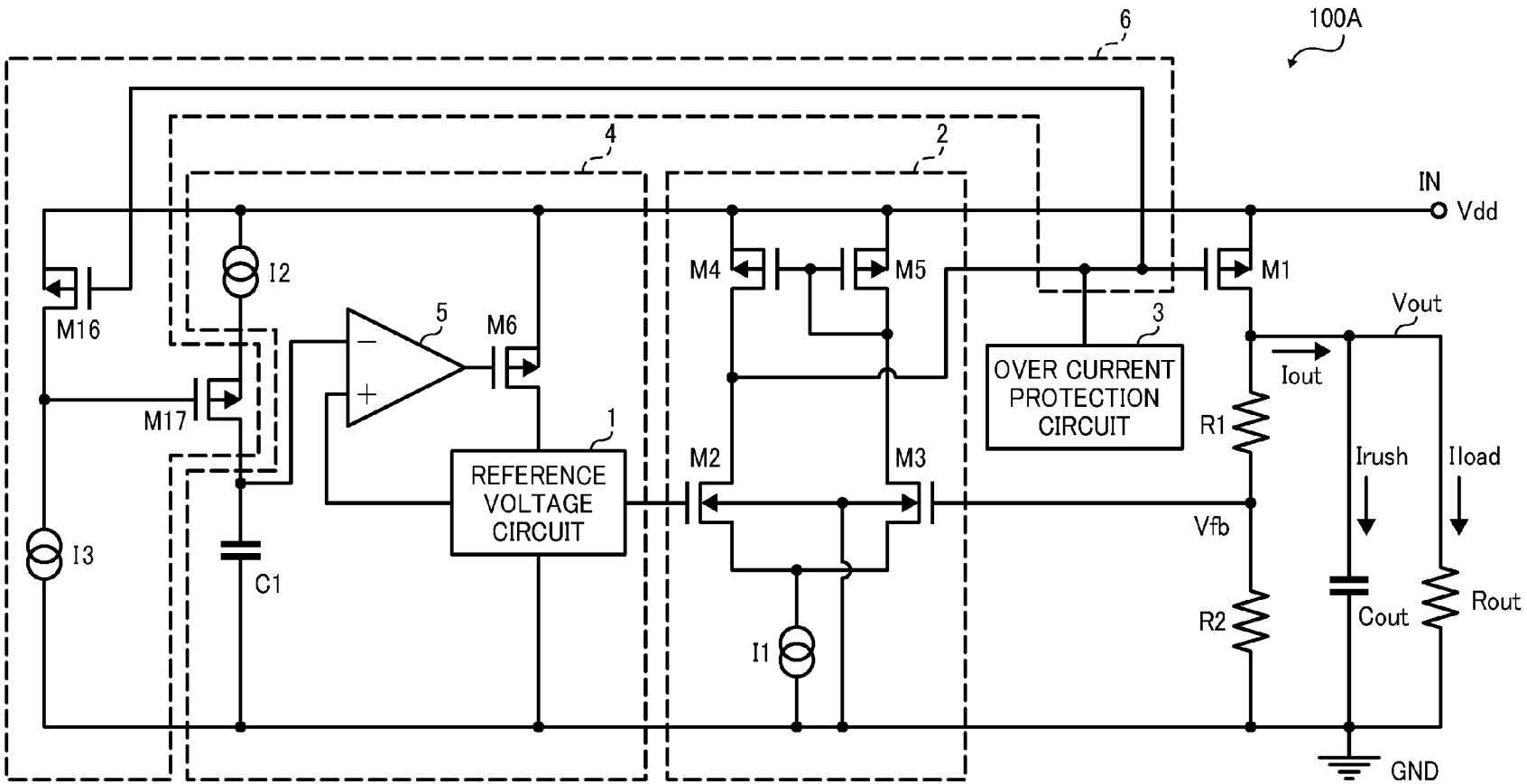
FIG. 9 illustrates circuitry of a constant-voltage circuit device using a series regulator according to another illustrative embodiment.

FIG. 9 illustrates circuitry of a constant-voltage circuit device 100A using a series regulator according to another embodiment.

Differently from the constant-voltage circuit device 100 shown in FIG. 4, the constant-voltage circuit device 100A shown in FIG. 9 includes an inrush current restriction circuit 6. Other than that, the configuration of the constant-voltage circuit device 100A is similar to that shown in FIG. 4, and thus a description thereof is omitted.

The inrush current restriction circuit 6 includes a current detection transistor M16, a transistor M17 for soft-start restriction, and a constant current source I3. The current detection transistor M16 has a source and a gate respectively connected to the source and the gate of the output transistor M1. A drain of the current detection transistor M16 is connected to the constant current source I3. A source, a drain, and a gate of the transistor M17 for soft-start restriction are respectively connected to the constant current source I2, the capacitor C1 for soft start, and a junction node between the current detection transistor M16 and the constant current source I3.

Here, because the output transistor M1 and the current detection transistor M16 form a current mirror circuit, a drain current of the current detection transistor M16 is proportional to the drain current of the output transistor M1.

For example, it is assumed that the output transistor M1 has a width (W) of 10000 μm and a length (L) of 0.5 μm, and the current detection transistor M16 has a width (W) of 2 μm and a length (L) of 0.5 μm. In this case, when the drain current of the output transistor M1 is 80 mA, the drain current of the current detection transistor M16 is 16 μA. Herein, by setting the constant current source I3 to 16 μA, when the drain current of the output transistor M1 is greater than 80 mA, the gate voltage of the transistor M17 for soft-start restriction rises to a voltage close to the power source voltage Vdd, and then charge given to the capacitor C1 for soft start from the constant current source I2 is stopped. As a result, the reference voltage Vref stops to increase when the output current Iout exceeds the current determined by the inrush current restriction circuit 6 during the soft start period. Subsequently, the output current Iout decreases accordingly, and then the transistor M17 for soft-start restriction turns on to start charging of the capacitor C1 for soft start. Thus, the output current Iout at the start-up can be controlled not by the overcurrent protection circuit 3 but by the electrical current determined by the inrush current restriction circuit 6, and the soft start circuit 4 changes the rising time according to the size of the output current Iout.

Figure 10A:
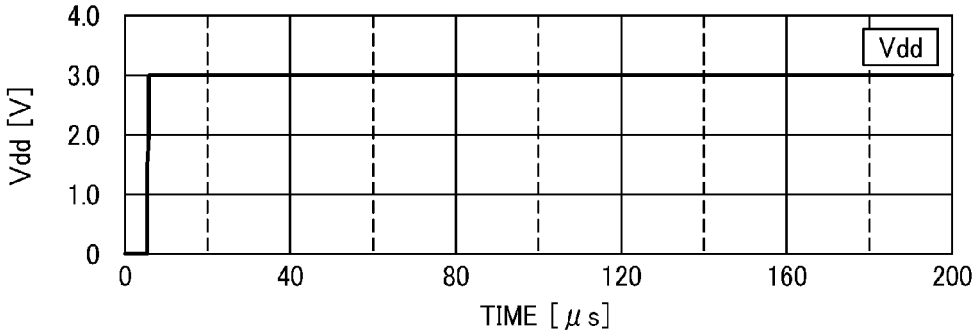
FIGS. 10A, 10B, and 10C respectively illustrate relations between time at the start-up and waveforms of a power source voltage Vdd; a reference voltage Vref and an output voltage Vout; and an output current Iout in the constant-voltage circuit device shown in FIG. 9.
Figure 10B:
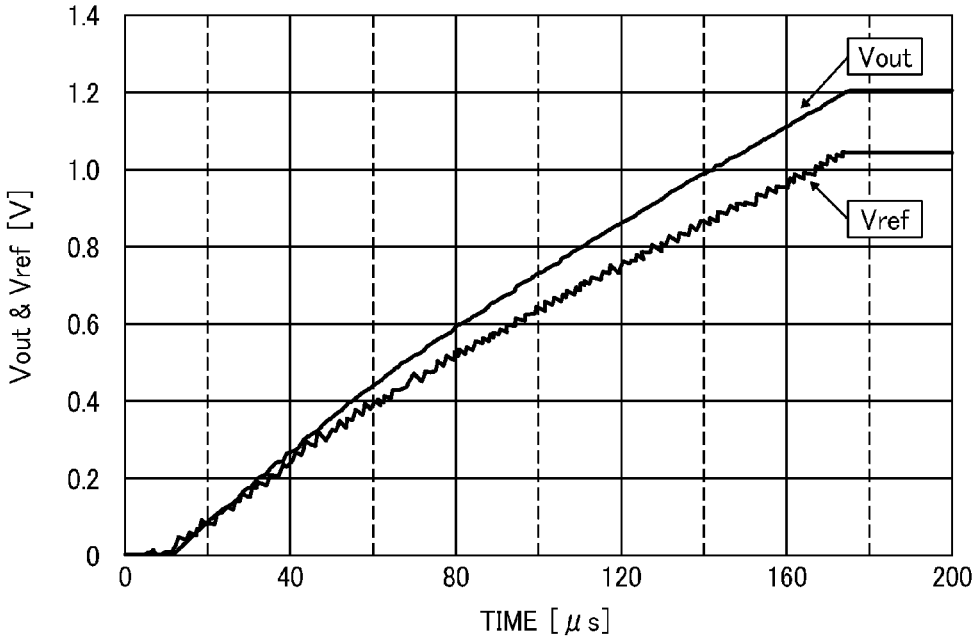
Figure 10C:
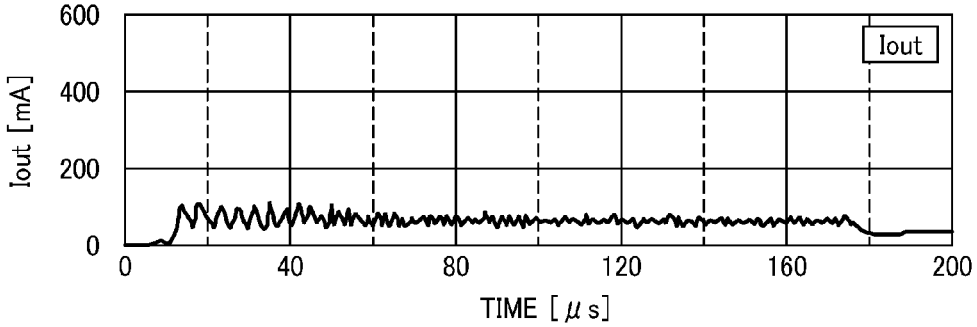

FIGS. 10A, 10B, and 10C respectively illustrate waveforms of the power source voltage Vdd; the reference voltage Vref and the output voltage Vout; and the output current Iout in the constant-voltage circuit device 100A shown in FIG. 9. These voltage waveforms are obtained under the conditions that the output capacitor Cout is 10 μF similarly to those shown in FIGS. 8A through 8C, and that the inrush current restriction circuit 6 operates when the output current Iout is greater than 80 mA as described above.

In FIGS. 10A through 10C, although the time period required for the reference voltage Vref to reach a desired voltage is set to 40 μs similarly to the voltage waveforms shown in FIG. 8, this rising time of the reference voltage Vref is about 170 μs because the inrush current restriction circuit 6 restricts the rise of the reference voltage Vref as required. As a result, the reference voltage Vref can increase linearly while monitoring the output current Iout, which is substantially similar to the inrush current Irush, as required, and thus a proper soft start waveform can be obtained. After the reference voltage Vref reaches the desired voltage, the soft start circuit 4 as well as the inrush current restriction circuit 6 have no effects on the reference voltage Vref. Therefore, the output current Iout can be decreased to an electrical current determined not by the inrush current restriction circuit 6 but by the overcurrent protection circuit 3. More specifically, in the case shown in FIGS. 10A through 10C, the output current Iout can be decreased to 400 mA not to 80 mA.

It is to be noted that, although the soft start circuit 4 or 4A used in the above-described embodiments controls the PMOS transistor M6 for controlling the reference voltage circuit based on the output from the differential amplifier circuit 5, the embodiments of the present invention is not limited thereto. Alternatively, any given circuit that includes the capacitor and the charging circuit therefor may be used. Therefore, a method that controls a driver gate, not the reference voltage, may be used.

Figure 11:
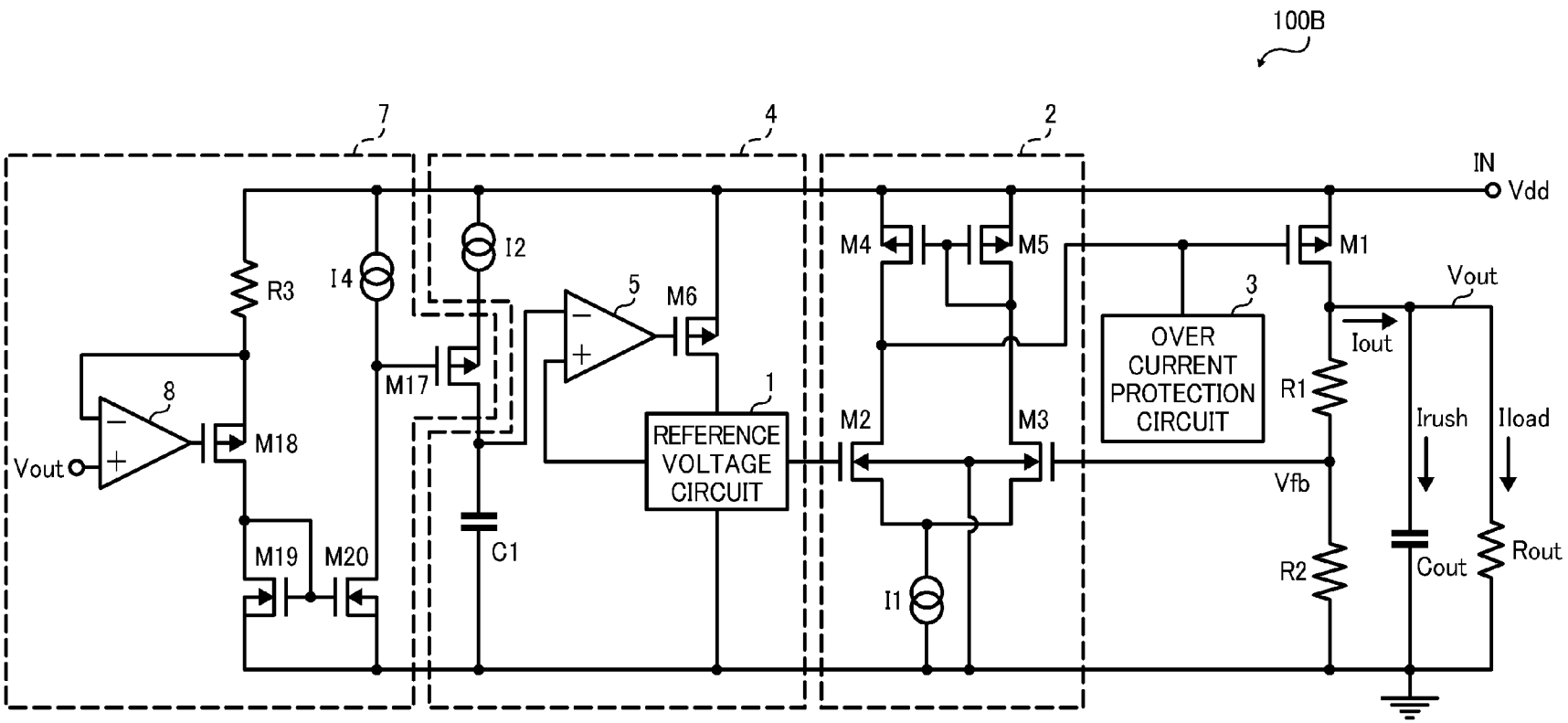
FIG. 11 illustrates circuitry of a constant-voltage circuit device using a series regulator according to another illustrative embodiment.

FIG. 11 illustrates circuitry of a constant-voltage circuit device 100B using a series regulator according to another embodiment.

Differently from the constant-voltage circuit device 100 shown in FIG. 4, the constant-voltage circuit device 100B shown in FIG. 11 includes an voltage difference detection circuit 7. Other than that, the configuration of the constant-voltage circuit device 100A is similar to that shown in FIG. 4, and thus a description thereof is omitted.

The voltage difference detection circuit 7 detects differences between the input voltage and the output voltage and includes a transistor M17 for soft start restriction, a resistor R3 for electric current conversion, a PMOS transistor M18, a differential amplifier circuit 8, NMOS transistors M19 and M20, and a constant current source I4. The resistor R3 is connected between an input terminal IN and a source of the PMOS transistor 18, and a junction node therebetween is connected to an inverting input terminal of the differential amplifier circuit 8.

A non-inverting input terminal of the differential amplifier circuit 8 is connected to an output terminal, and an output from the differential amplifier circuit 8 is input to a gate of the PMOS transistor M18. Sources of the NMOS transistors M19 and 20 are connected to the ground voltage, there gates are connected together, and a junction node therebetween is connected to a drain of the NMOS transistor M19. The drain of the NMOS transistor M19 is further connected to a drain of the PMOS transistor M18. A drain of the NMOS transistor M20 is connected to the constant current source I4, and a junction node therebetween is connected to a gate of the transistor M17. A drain and a source of the transistor M17 for soft-start restriction are respectively connected to the capacitor C1 for soft start and the constant current source I2 similarly to the constant-voltage circuit device 100A shown in FIG. 9.

The differential amplifier circuit 8 controls the gate of the PMOS transistor M18 so that the drain voltage of the PMOS transistor 18 equals the voltage of the output terminal. As a result, the input voltage and the output voltage are respectively applied to both ends of the resistor R3. Then, the electrical current obtained by dividing the difference between the input voltage and the output voltage by the resistor R3 flows to both the PMOS transistor M18 and the NMOS transistor M19. Because the NMOS transistors M19 and M20 form a current mirror circuit, the drain current of the NMOS transistor M20 is proportional to the drain current of the NMOS transistor M19.

Herein, the resistor R3 for electric current conversion is set to 1 MΩ, the NMOS transistors M19 and M20 are of an identical size, and the constant current source I4 is set to 0.3 μA.

When the input voltage Vin is 4.0 V and the output voltage Vout is 3.0 V, an electrical current EC calculated by the following formula flows to the NMOS transistor M20.

$$EC=(Vin-Vout)/R3$$

In the above-described case, an electrical current of 1 μA flows to the NMOS transistor M20. As the constant current source I4 is 0.3 μA, the gate voltage of the transistor 17 for soft-start restriction (drain voltage of the NMOS transistor M20) decreases to close the ground voltage and then the constant current source I2 charges the capacitor C1 for soft start.

However, when the voltage at the input terminal IN is 3.2 V and the output voltage Vout is 3.0 V, only an electrical current of 0.2 μA flows to the NMOS transistor M20. Therefore, the gate voltage of the transistor 17 for soft-start restriction rises to close the power source voltage Vdd, and then the constant current source I2 stops to charge the capacitor C1 for soft start. As a result, when the difference between the input voltage and the output voltage decreases blow a given voltage during the soft start-up, the reference voltage Vref stops to rise.

Subsequently, the transistor M17 for soft start restriction turns on when the input voltage has increased, and the constant current source I2 reassumes charging of the capacitor 1 for soft start. As a result, even when the input voltage rises relatively slowly at the start-up, the voltage difference detection circuit 7 that detects differences between the input voltage and the output voltage controls the charge given to the capacitor C1 for soft start, and accordingly the rising time is changed.

Figure 12A:
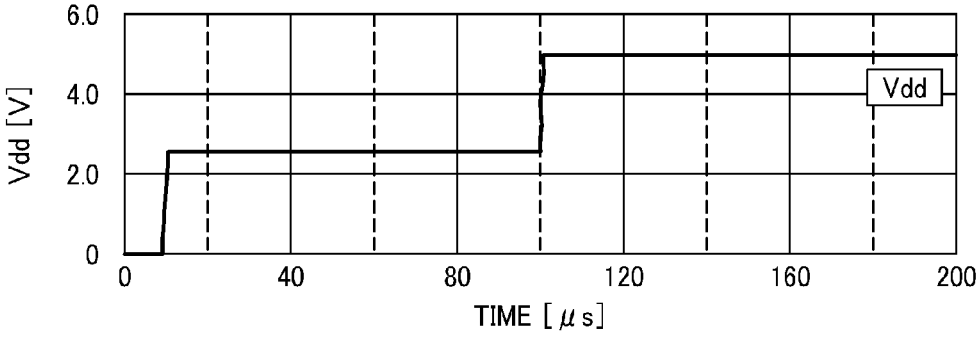
FIGS. 12A, 12B, and 12C respectively illustrate relations between time at the start-up and waveforms of a power source voltage Vdd; a reference voltage Vref and an output voltage Vout; and an output current Iout in the constant-voltage circuit device shown in FIG. 11.
Figure 12B:
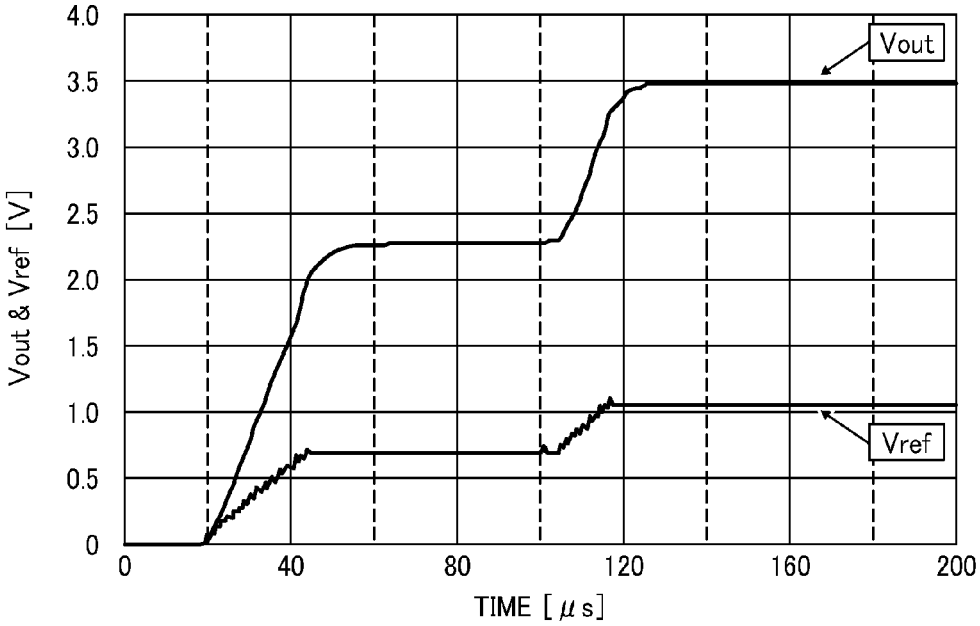
Figure 12C:
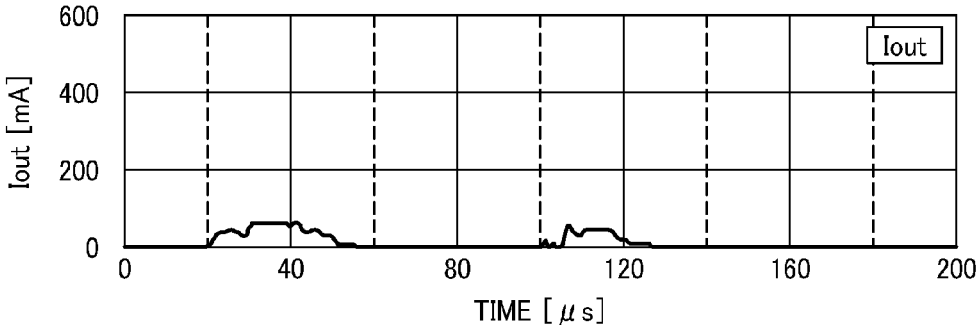

FIGS. 12A, 12B, and 12C respectively illustrate the relations between time at the start-up and waveforms of the power source voltage Vdd; the reference voltage Vref and the output voltage Vout; and the output current Iout in the constant-voltage circuit device 100B shown in FIG. 11. There are waveforms when the input voltage is increased irregularly, that is, the increase is interrupted at 2.5 V and then the input voltage is further increased to 5.0 V. The output voltage Vout is 3.5 V, and the output capacitor Cout is 0.5 μF.

The voltage difference detection circuit 7 is set to restrict the charge given to the capacitor C1 for soft start when the difference between the input voltage and the output voltage decreases to 0.3 V or lower. Although the time period required for the reference voltage Vref to rise the desired voltage is set to 40 μs, when the input voltage stops to rise at 2.5 V, the reference voltage Vref stops to rise accordingly because the voltage difference detection circuit 7 restricts the rise of the reference voltage Vref. As a result, a proper soft start wave form can be obtained even while the input voltage increases from 2.5 V to 5.0 V. After the output voltage Vout has reaches the desired voltage, the difference between the input voltage and the output voltage can be lower then 0.3 V because neither the soft start circuit 4 nor the voltage difference detection circuit 7 effect the operation of the reference voltage Vref.

Numerous additional modifications and variations are possible in light of the above teachings. It is therefore to be understood that, within the scope of the appended claims, the disclosure of this patent specification may be practiced otherwise than as specifically described herein.

What is claimed is:

1. A constant-voltage circuit device to convert a voltage input to an input terminal and output a predetermined constant voltage from an output terminal, the constant-voltage circuit device comprising:

an output transistor to output an electrical current from the input terminal to the output terminal in response to a control signal;

a reference voltage circuit to generate a predetermined reference voltage;

a control circuit to adjust a voltage proportional to the output voltage output from the output terminal to the reference voltage output from the reference voltage circuit by controlling the output transistor; and a soft start circuit including a capacitor for soft start that is charged at start-up, and a current control unit to control an electrical current supplied to the reference voltage circuit, the current control unit adjusting the reference voltage to a voltage determined by the capacitor for soft start at the start-up until the reference voltage reaches a desired voltage.

2. The constant-voltage circuit device according to claim 1, wherein the soft start circuit further comprises a differential amplifier circuit and a constant current source, wherein the current control unit is a control transistor, the differential amplifier circuit has a first input terminal connected to an output terminal of the reference voltage circuit and a second input terminal connected to a junction node between the constant current source and the capacitor for soft start, and an output from the differential amplifier circuit is given to a control electrode of the control transistor.

3. The constant-voltage circuit device according to claim 2, wherein the differential amplifier circuit comprises;

a pair of input transistors forming a differential pair; and a current mirror circuit serving as a load to the differential pair, wherein the input transistors are depression-type NMOS transistors.

4. The constant-voltage circuit device according to claim 3, wherein the input transistors have unequal gate widths.

5. The constant-voltage circuit device according to claim 3, wherein the input transistors have unequal gate lengths.

6. The constant-voltage circuit device according to claim 3, wherein a tail current of the differential amplifier circuit is controlled by a depression-type NMOS transistor.

7. The constant-voltage circuit device according to claim 3, further comprising a discharge unit to discharge both input terminals of the differential amplifier circuit when the constant-voltage circuit device is off.

8. A constant-voltage circuit device to convert a voltage input to an input terminal and output a predetermined constant voltage from an output terminal, the constant-voltage circuit device comprising:

an output transistor to output an electrical current from the input terminal to the output terminal in response to a control signal;

a reference voltage circuit to generate a predetermined reference voltage;

a control circuit to adjust a voltage proportional to the output voltage output from the output terminal to the reference voltage output from the reference voltage circuit by controlling the output transistor;

a soft start circuit including a capacitor for soft start that is charged at start-up, the soft start circuit raising the output voltage output from the output terminal according to a time period during which the capacitor for soft start is charged;

a current detection unit to detect an electrical current flowing to the output transistor; and a charge-current control unit to control a charge given to the capacitor for soft start according to an electrical current detected by the current detection unit at the start-up.

9. The constant-voltage circuit device according to claim 8, wherein the soft start circuit further comprises a differential amplifier circuit, a constant current source, and a control transistor to control an electrical current supplied to the reference voltage circuit, wherein the differential amplifier circuit has a first input terminal connected to an output terminal of the reference voltage circuit and a second input terminal connected to a junction node between the charge-current control unit and the capacitor for soft start, and an output from the differential amplifier circuit is given to a control electrode of the control transistor.

10. The constant-voltage circuit device according to claim 9, wherein the differential amplifier circuit comprises:

a pair of input transistors forming a differential pair; and a current mirror circuit serving as a load to the differential pair, wherein the input transistors are depression-type NMOS transistors.

11. The constant-voltage circuit device according to claim 10, wherein the input transistors have unequal gate widths or unequal gate lengths.

12. The constant-voltage circuit device according to claim 10, wherein a tail current of the differential amplifier circuit is controlled by a depression-type NMOS transistor.

13. The constant-voltage circuit device according to claim 10, further comprising a discharge unit to discharge both input terminals of the differential amplifier circuit when the constant-voltage circuit device is off.

14. A constant-voltage circuit device to convert a voltage input to an input terminal and output a predetermined constant voltage from an output terminal, the constant-voltage circuit device comprising:

an output transistor to output an electrical current from the input terminal to the output terminal in response to a control signal;

a reference voltage circuit to generate a predetermined reference voltage;

a control circuit to adjust a voltage proportional to the output voltage output from the output terminal to the reference voltage output from the reference voltage circuit by controlling the output transistor;

a soft start circuit including a capacitor for soft start that is charged at start-up, the soft start circuit raising the output voltage output from the output terminal according to a time period during which the capacitor for soft start is charged;

a voltage difference detection unit to detect a difference between the input voltage and the constant voltage output from the output terminal; and a charge-current control unit to control a charge given to the capacitor for soft start according to the difference detected by the voltage difference detection unit at the start-up.

15. The constant-voltage circuit device according to claim 14, wherein the soft start circuit further comprises a differential amplifier circuit, a constant current source, and a control transistor to control an electrical current supplied to the reference voltage circuit, wherein the differential amplifier circuit has a first input terminal connected to an output terminal of the reference voltage circuit and second input terminal connected to a junction node between the charge-current control unit and the capacitor for soft start, and an output from the differential amplifier circuit is given to a control electrode of the control transistor.

16. The constant-voltage circuit device according to claim 15, wherein the differential amplifier circuit comprises:

a pair of input transistors forming a differential pair; and a current mirror circuit serving as a load to the differential pair, wherein the input transistors are depression-type NMOS transistors.

17. The constant-voltage circuit device according to claim 16, wherein the input transistors have unequal gate widths or unequal gate lengths.

18. The constant-voltage circuit device according to claim 16, wherein a tail current of the differential amplifier circuit is controlled by a depression-type NMOS transistor.

19. The constant-voltage circuit device according to claim 16, further comprising a discharge unit to discharge both input terminals of the differential amplifier circuit when the constant-voltage circuit device is off.

* * * * *